US006401304B1

(12) United States Patent
Dossett

(10) Patent No.: US 6,401,304 B1
(45) Date of Patent: Jun. 11, 2002

(54) PRODUCT STOCKING METHOD AND DEVICE

(75) Inventor: Larry Russell Dossett, Manchester, GA (US)

(73) Assignee: Goody Products, Inc., Peachtree City, GA (US)

( * ) Notice: Subject to any disclaimer, the term of this patent is extended or adjusted under 35 U.S.C. 154(b) by 0 days.

(21) Appl. No.: 09/564,762

(22) Filed: May 4, 2000

Related U.S. Application Data

(60) Provisional application No. 60/132,837, filed on May 6, 1999.

(51) Int. Cl.[7] ..... G90F 3/18; G90F 23/00; A44B 21/00

(52) U.S. Cl. ..... 24/16 PB; 40/668; 53/399; 24/304; 24/30.5 P

(58) Field of Search ..... 24/16 PB, 30.55, 24/30.5 P, 17 AP, 304; 40/668, 665; 206/806, 807; 513/390, 399, 581, 447; 29/241

(56) References Cited

U.S. PATENT DOCUMENTS

| | | | | | |
|---|---|---|---|---|---|
| 2,016,059 | A | * | 10/1935 | Stevens | 40/668 |
| 2,153,227 | A | * | 4/1939 | Allstatter | 40/668 |
| 2,554,105 | A | * | 5/1951 | Heinle | 24/16 PB X |
| 4,149,329 | A | * | 4/1979 | Graves | 40/668 |
| 4,570,368 | A | * | 2/1986 | Stover | 24/16 PB X |
| 4,877,068 | A | * | 10/1989 | Blake | 53/390 |
| 5,584,103 | A | * | 12/1996 | Slavin | 24/16 PB |
| 5,878,520 | A | * | 3/1999 | Milbrandt et al. | 24/16 PB |
| 6,058,639 | A | * | 5/2000 | Tinklenberg et al. | 40/665 |
| 6,226,911 | B1 | * | 5/2001 | Wescombe | 40/668 |

* cited by examiner

*Primary Examiner*—Robert J. Sandy
(74) *Attorney, Agent, or Firm*—Marshall, Gerstein & Borun

(57) ABSTRACT

A product stocking device that retains a plurality of display packages, so that the plurality of display packages are readily aligned for simplified mounting onto a display hanger is disclosed. The stocking device has a tag section and a tail section, the tail section loops through apertures in the plurality of display packages and the tail section is coupled to a coupling portion on the tag section.

16 Claims, 3 Drawing Sheets

PRODUCT STOCKING METHOD AND DEVICE

This application claims benefit to U.S. provisional application Ser. No. 60/132,837, filed May 6, 1999.

FIELD OF THE INVENTION

The invention relates to a product stocking device for placing a plurality of packaged products on a display hanger in a substantially single step.

BACKGROUND OF THE INVENTION

It is well known to display products packaged using a variety of display packages, such as display bags, blister packs, display cards, display containers, or the like. All of the display packages having an aperture adjacent the top of each package, such that the display packages may hang from display hangers or peg hooks that extend from a display or display shelf.

Conventionally to display the display packages, a stocker retrieves each display bag, blister pack, display card, display container, or the like from a box or larger bag containing a multiplicity of display packages and mounts each display package individually onto a display hanger. Alternatively, a stocker takes a plurality of display packages from the box or larger bag and aligns the mounting apertures by hand and in turn mounts the plurality of display packages onto a display hanger. For the stocker, the process of mounting the display package onto the display hangers is a tedious and time consuming task that requires exceedingly repetitive work for the stocker. Having such repetitive work for a stocker increases costs for the store employing the stocker and also increases the chances that while the stocker is placing the display packages onto the display hangers that the individual display package could be dropped by the stocker, possibly causing damage to the product or the packaging itself could be torn or damaged because of the careless package handling brought on by the tedium of the stocking task.

It is known in the art to insert a common twist tie through the apertures of a plurality of display bags. The twist tie substantially causes coaxial alignment of the display bag apertures. The twist tie partially solves the problem of requiring a stocker to stock individual display bags one at a time. A twist tie however has the disadvantage of being difficult to manually disengage from the plurality of bags without the use of a suitable tool. Further, a twist tie requires a substantial twisting effort in putting together the plurality of bags. Further still, a twist tie does not have an area providing for easy labeling of the products that are held by the twist tie or for easy grasping by a stocker.

Thus, there is a need and desire for a device that improves the efficiency of handling a multiplicity of display packages to be mounted onto display hangers. There is also a need and desire for an efficient method of mounting a plurality of display packages onto display hangers. Further, there is a need and desire for a device which keeps a plurality of display packages together so that the plurality of display packages can be easily mounted onto display hangers in a substantially single step. Further still, there is a need and desire for a device that holds together a plurality of display packages that can be easily manufactured with little expense and can be easily packaged along with the plurality of display packages in a case or box containing a plurality of display packages.

SUMMARY OF THE INVENTION

The present invention relates to a product stocking device for retaining a plurality of display packages. The product stocking device includes a first section being manually graspable and having a proximal and distal end. The product stocking device also includes a second section having a proximal and distal end. The proximal end of the second section is coupled to the distal end of the first section, and the second section has a coupling portion. The plurality of display packages are selectively retained on the second section.

The present invention further relates to a system for packaging a multiplicity of display packages in a shipping container. Each display package has a display aperture. The system includes at least one stocking device having a first end and a second end. The first end is threadable through the display apertures in a plurality of display packages. The at least one stocking device has a coupling aperture intermediate the first end and the second end to which the first end is coupled and retained to form a loop. At least one band encircles and binds each plurality of display packages that is retained by the at least one stocking device.

The present invention still further relates to a method of packaging a multiplicity of display packages. Each display package has a display aperture. The method includes threading a stocking device, having a first end and a second end, and a coupling portion intermediate the first and second ends, through the display apertures of a plurality of display packages. The method also includes coupling the first end of the stocking device to the retaining aperture, to form a loop. The method further includes banding the plurality of display packages being retained by the stocking device and placing the plurality of display packages being retained by the stocking device into a shipping container.

BRIEF DESCRIPTION OF THE FIGURES

The invention will become more fully understood from the following detailed description, taken in conjunction with the accompanying figures, wherein like reference numerals refer to like elements, in which.

DETAILED DESCRIPTION OF EXEMPLARY EMBODIMENTS

Figure 1:
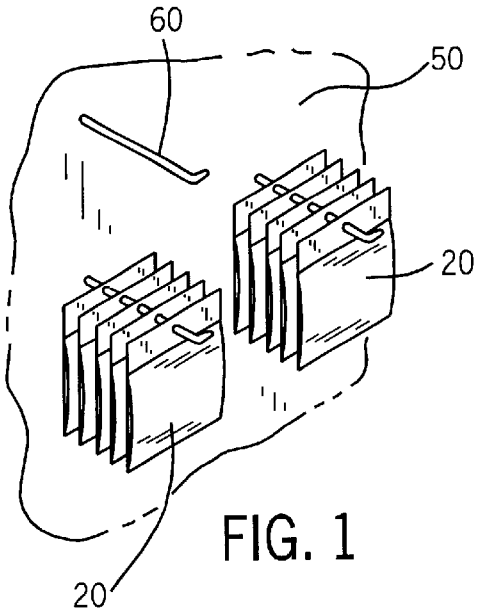
FIG. 1 is an illustration of a plurality of bags hanging from a display hanger.
Figure 3:
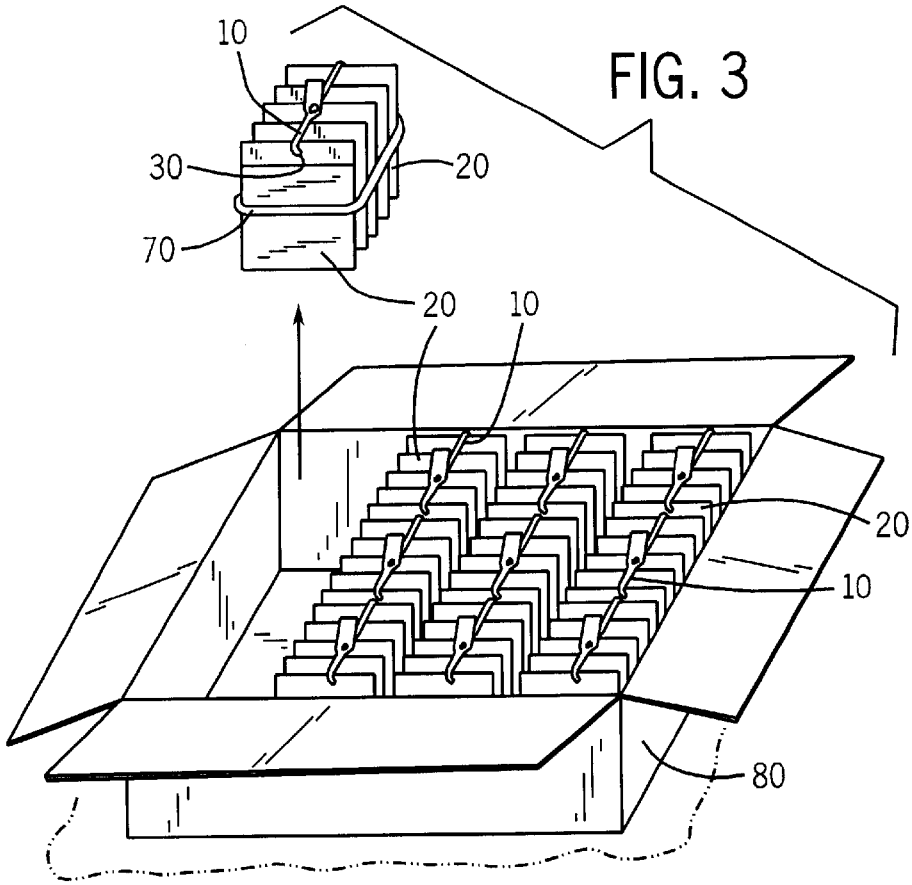
FIG. 3 is an illustration of a shipping carton holding a multiplicity of bags, the multiplicity of bags being held together in a plurality of subgroups by an exemplary product stocking.

As depicted in FIGS. 1 and 3, a product stocking device 10 for retaining a plurality of display packages, such as, display bags 20, blister packs, display cards, or display containers, is shown. Display bags 20 shown in the figures are exemplary of the type of display package that can be utilized with the present invention however, any of a variety of display packages, not limited to those disclosed may be used, as long as the display packages have at least one aperture for hanging on a display hanger, peg, or hook. Each display bag 20 contains a product, such as, but not limited to elastic bands. Alternatively any suitable product may be contained in display bags 10 or other display packages. Each display bag 10 has an aperture 30 adjacent the top of display bag 10 for mounting onto a display hanger 40, as depicted in FIG. 1, in a store, that protrudes from an upright display 50, a display shelf, case, or the like.

Referring to FIG. 1, FIG. 1 depicts upright display 50 having a plurality of substantially horizontal hangers 60 extending outwardly therefrom. Upright display 50 is configured to display a multiplicity of packaged products, the packaged products hanging from display hangers 60.

Figure 2:
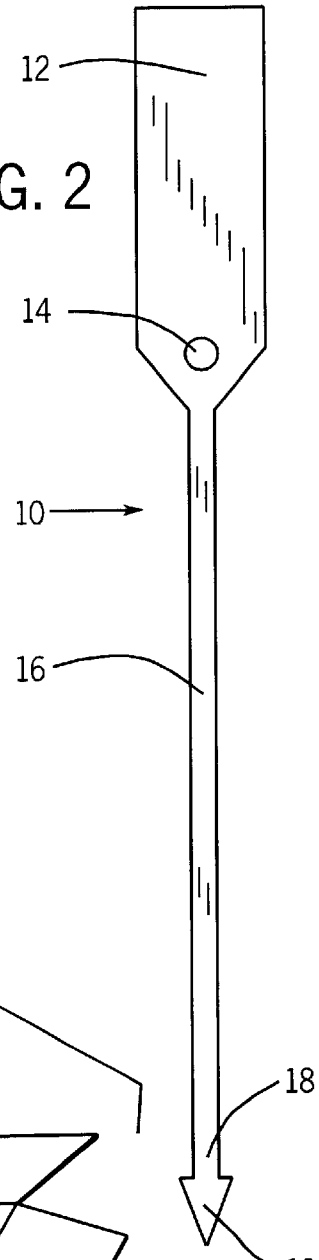
FIG. 2 is an illustration of an exemplary product stocking device.

Referring now to FIG. 2, an exemplary product stocking device 10 is depicted. Exemplary product stocking device 10 includes a tag area 12 having a multiplicity of functions, including, but not limited to, use as a label, a grasping area, and a hanging area. Tag 12, in an alternative embodiment, may include, but is not limited to, having a hanging aperture (not shown) and a coupling aperture 14. Product stocking device 10 further includes a tail section 16 that is attached adjacent the coupling aperture and extending from the tag section of product stocking device 10. The proximal end of tail section 16 is attached to the tag section and the distal end 18 of tail section 16 having an end barb 19. A tail section of this type is a preferred embodiment of a one-way stocking device.

Figure 6:
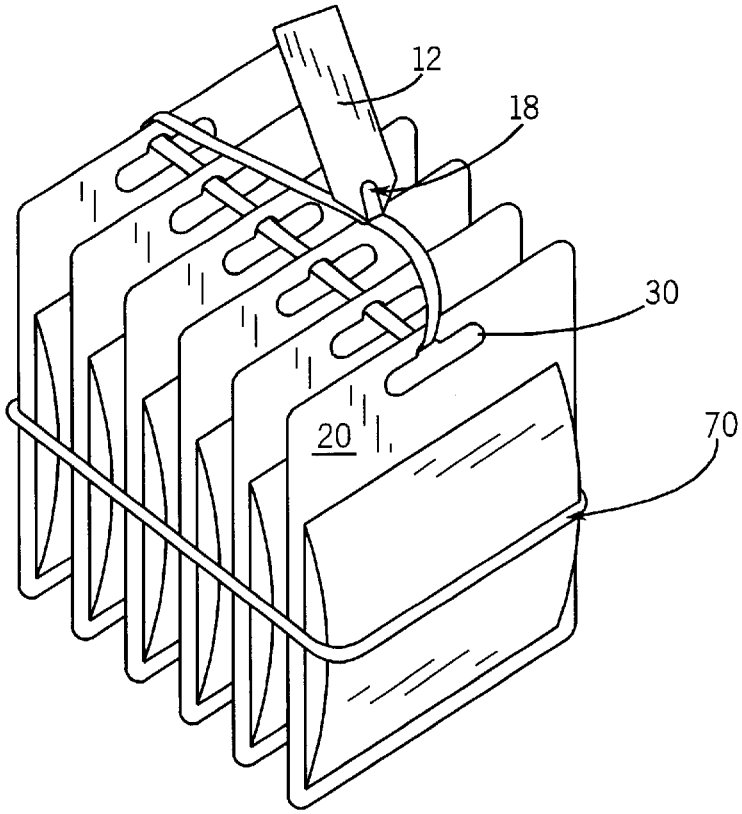
FIG. 6 is an illustration of an exemplary stocking device using a heat melt coupling.
Figure 7:
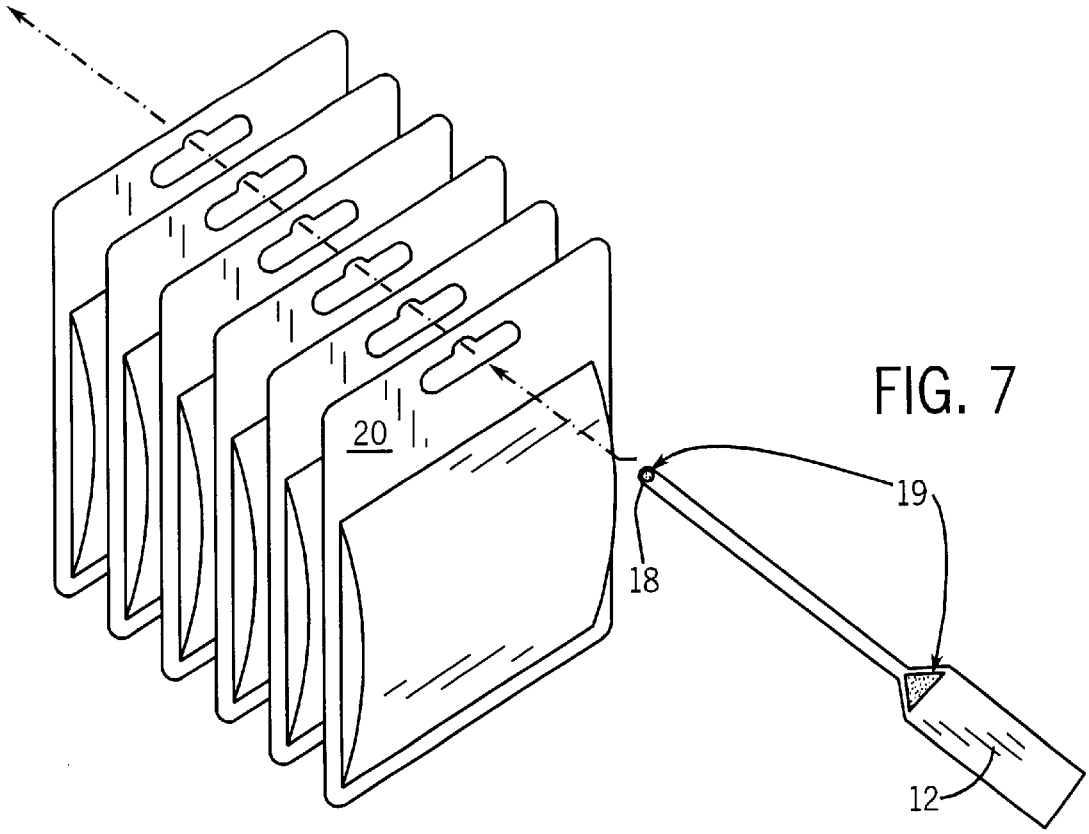
FIG. 7 is an illustration of an exemplary stocking device using an adhesive coupling.

Alternatively, product stocking device 10 may be configured in a variety of other arrangements and manufactured from a variety of materials having portions that extend through display packages, such as display bags 20, and further have portions that include coupling portions. Product stocking device 10 may be a plastic tab threaded through a display package, such as display bag 20 and then attached to itself by heat melt plastic operation (depicted in FIG. 6, by distal end 18 being heat melted to tag area 12). Further, product stocking device 10 may be a paper tab that is threaded through the display package apertures and then attached to itself by an adhesive or glue (depicted in FIG. 7, by adhesive areas 19 on distal end 18 and on tag area 12). Further still, product stocking device 10 may be any of a variety of plastic locking devices in which an end of the device is threaded through a coupling aperture and then mechanically fastened to itself by any of a number of plastic locking devices or plastic locking configurations, such as, but not limited to, the configurations depicted in FIG. 2.

In operation, product stocking device 10 holds a plurality of display bags together by threading product stocking device 10 through bag apertures 30, and further through an aperture 14 in the bag stocking device itself. In a preferred embodiment a rubber band 70, elastic band, flexible band, non-flexible band or other retaining device is wrapped around the plurality of bags to hold the bags substantially in line with one another and to prevent the shifting or tangling of products during shipping.

At a packaging facility, products, are bagged and sealed in display bags 20. Once bagged, the retaining section or tail section 16 of the display bag stocking device is threaded through apertures 30 of a plurality of display bags 20, such as the five display bags, in the exemplary embodiment, depicted in FIG. 3. However, the product stocking device would not be limited to five bags or containers, any reasonable and suitable number of bags or containers could be retained by the product stocking device. Once the tail section of the product stocking device has been threaded through bag apertures 30, the distal end 18 of the tail section is threaded and pulled through retaining aperture 14 of the stocking device past barbed section 19 of tail section 16. Barbed section 19 acts to resistively prevent tail section 16 from being pulled back through retaining aperture 14 by causing interference with retaining aperture 14 (the one-way feature) because the width of barbed section 19 is larger than the diameter of retaining aperture 14. However, other geometric configurations or devices could be used to prevent tail section 16 from being pulled back through retaining aperture 14, for example a single barb could be used instead of the double barb shown, or an alternate protrusion or other coupling or linking configurations could be used. Further, in an alternative embodiment, the aperture may include a slit extending to the side of tag section 12 but allowing tail section 16 to be inserted into the slit and substantially retained thereon.

After a plurality of bags 20 have been retained by product stocking device 10 they may be bound, in an exemplary embodiment, by an elastic or rubber band 70 around the mid-section of display bags 20 to keep them more firmly and compactly together during delivery of the products. Also, band 70 provides that each group of bags does not substantially interfere with other groups of bags in a case, a carton, or a box 80 to be sent to a customer. However, in an alternative embodiment bags 20 need not be bound together by any device other than product stocking device 10 itself. After bags 20 have been bound by rubber bands 70, they may be inserted into a case or box 80 to be sent to the customer. A plurality of these bound bag sets each being retained by product stocking device 10 may be inserted into a single case.

Figure 4:
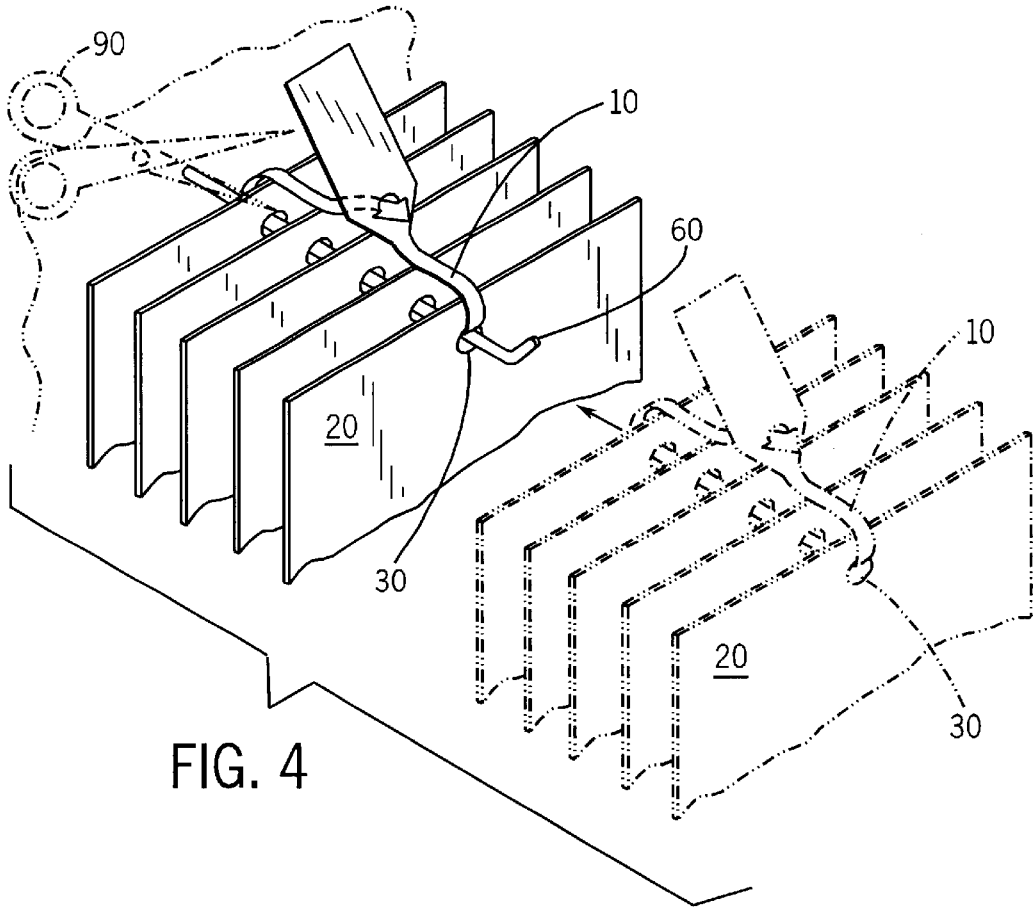
FIG. 4 is an illustration of a plurality of bags being placed on a display hanger using a product stocking device.

When box 80 is received at a store, or any other place that the products are going to be displayed, each bound set of bags 20 is simply lifted from the box or case by grasping the stocking device and lifting the set of bags from the box, as depicted in FIG. 3. Because the tail section of product stocking device 10 is threaded through bag apertures 30, the bag apertures are automatically substantially coaxially lined. Because bag apertures 30 are substantially coaxially aligned, the plurality of bags may be slid directly onto display hanger 60 substantially simultaneously, as depicted in FIG. 4. Thus, the stocker has avoided having to individually mount each and every of the plurality of bags 20 onto display hanger 60.

Figure 5:
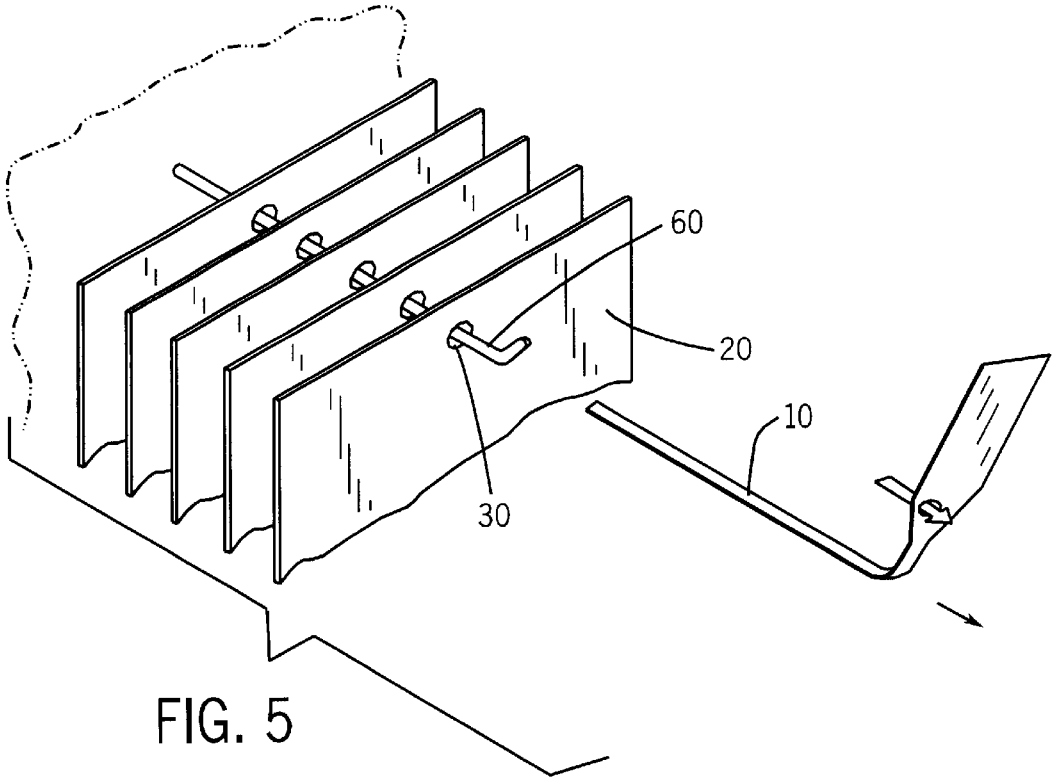
FIG. 5 is an illustration of the product stocking device being removed from the products.

Once the plurality of bags 20 has been mounted on the display hanger 60, product stocking device 10 can then be removed by manually pulling the tail section distal end 18 back through retaining aperture 14 with sufficient force to slightly deform the barbed section or the retaining aperture so that the distal end slides back through the retaining aperture and releases the bags from being retained by the retaining aperture. The tail section is then pulled back through the bag apertures until the stocking device is completely separated from the bags. Alternatively, a stocker may just tear or cut (using a device, such as, but not limited to, a scissors 90, depicted in FIG. 4) product stocking device 10 from the plurality of bags 20, thereby further increasing efficiency. Product stocking device 10 is simply slid out from apertures 30, as depicted in FIG. 5. Once removed from bags 20, product stocking device 10 may be easily recycled or disposed of. Alternatively, the stocker can remove the stocking device before mounting the plurality of bags on the display hanger as long as the stocker takes steps to maintain the alignment of the plurality of bags. Further, if product stocking device 10 is not cut, product stocking device 10 may be reused, if desired.

Product stocking device 10 may be manufactured from a variety of materials including, but not limited to, polymeric or plastic materials, paper or cardboard materials, composite materials, or any other variety of reinforced materials if the weight of the plurality of bags or containers is substantial.

While the detailed drawings, specific examples, and particular formulations given describe preferred or exemplary embodiments, they serve the purpose of illustration only. The materials and configurations shown and described may differ depending on the chosen performance characteristics and physical characteristics of the product stocking device. For example, the type of material used to form the product stocking device may differ. The product stocking device shown and described and the packages shown and described are not limited to the precise details and conditions disclosed. Furthermore, other substitutions, modifications, changes, and omissions may be made in the design, operating conditions, and arrangement of the preferred or exemplary embodiments without departing from the spirit of the invention as expressed in the appended claims.

What is claimed is:

1. A system for packaging a multiplicity of display packages in a shipping container, each display package having a display aperture, the system comprising:

at least one stocking device having a first end and a second end, the first end being threadable through the display apertures in a plurality of display packages, the first at least one stocking device having a coupling portion intermediate the first end and the second end to which the first end is coupled and retained to form a loop;

at least one band encircling and binding each plurality of display packages that is retained by the at least one stocking device.

2. The system of claim 1, wherein the first end includes a barb.

3. The system of claim 1, wherein the coupling portion includes a coupling aperture.

4. The system of claim 1, wherein the band includes a rubber band.

5. The system of claim 1, wherein the band includes an elastic band.

6. The system of claim 1, wherein the band includes a plastic band.

7. The system of claim 1, wherein the band includes a tie.

8. A method of merchandising a multiplicity of display packages, each display package having a display aperture for hanging on a display rack, the method comprising:

threading a stocking device, the stocking device having a first end and a second end, and a coupling portion intermediate the first and second ends, through the display apertures of a plurality of display packages;

coupling the first end of the stocking device to the retaining aperture, forming a loop;

placing the plurality of display packages being retained by the stocking device into a shipping container;

shipping the shipping container to a retail destination;

grasping the first end of the stocking device;

removing the plurality of display packages from the shipping container;

placing the display packages on the display rack; and severing the loop.

9. A product stocking device for retaining a plurality of display packages comprising:

a first section being manually graspable and having a proximal and distal end;

a second section having a proximal and distal end, the distal end of the second section being coupled to the proximal end of the first section, and the second section having a coupling portion; and a band selectively retaining the plurality of display packages, wherein the plurality of display packages are selectively retained on the second section.

10. The product stocking device of claim 9 wherein the band is a rubber band.

11. The product stocking device of claim 9 wherein the band is an elastic band.

12. The product stocking device of claim 9 wherein the band is a plastic band.

13. The product stocking device of claim 9 wherein the band is a tie.

14. A product stocking device for retaining a plurality of display packages comprising:

a first section being manually graspable and having a proximal and distal end;

a second section having a proximal and distal end, the distal end of the second section being coupled to the proximal end of the first section, and the second section having a coupling portion; and the coupling portion utilizes adhesive coupling, wherein the plurality of display packages are selectively retained on the second section.

15. A product stocking device for retaining a plurality of display packages comprising:

a first section being manually graspable and having a proximal and distal end;

a second section having a proximal and distal end, the distal end of the second section being coupled to the proximal end of the first section, and the second section having a coupling portion; and the coupling portion utilizes coupling by heating, wherein the plurality of display packages are selectively retained on the second section.

16. A method of packaging a multiplicity of display packages, each display package having a display aperture, the method comprising:

threading a stocking device, having a first end and a second end. and a coupling portion intermediate the first and second ends, through the display apertures of a plurality of display packages;

coupling the first end of the stocking device to the retaining aperture, forming a loop;

banding the plurality of display packages being retained by the stocking device:

placing the plurality of display packages being retained by the stocking device into a shipping container.

* * * * *